US005400227A

United States Patent [19]

Maglica et al.

[11] Patent Number: 5,400,227

[45] Date of Patent: * Mar. 21, 1995

[54] TAILCAP SWITCH FOCUS FLASHLIGHT

[75] Inventors: Anthony Maglica, Ontario; Robert J. DeLong, Temple City; Armis L. Lewis, Cucamonga, all of Calif.

[73] Assignee: Mag Instrument, Inc., Ontario, Calif.

[ * ] Notice: The portion of the term of this patent subsequent to Jun. 20, 2006 has been disclaimed.

[21] Appl. No.: 82,244

[22] Filed: Jun. 24, 1993

Related U.S. Application Data

[60] Division of Ser. No. 963,133, Oct. 19, 1992, abandoned, which is a division of Ser. No. 350,385, May 11, 1989, Pat. No. 5,158,358, which is a continuation of Ser. No. 106,296, Oct. 7, 1987, Pat. No. 4,841,417, which is a continuation-in-part of Ser. No. 43,086, Apr. 27, 1987, Pat. No. 4,819,141, which is a continuation-in-part of Ser. No. 34,918, Apr. 6, 1987, abandoned, which is a continuation of Ser. No. 828,729, Feb. 11, 1986, Pat. No. 4,658,336, which is a continuation of Ser. No. 648,032, Sep. 6, 1984, Pat. No. 4,577,263.

[51] Int. Cl.[6] ..... F21L 7/00

[52] U.S. Cl. ..... 362/206; 362/188

[58] Field of Search ..... 362/205, 206, 187, 188, 362/196, 202, 203, 204, 205, 206

[56] References Cited

U.S. PATENT DOCUMENTS

| | | | |
|---|---|---|---|
| Re. 29,047 | 11/1976 | Brindley | 240/10.66 |
| D. 263,170 | 2/1982 | Maglica | D26/2 |
| D. 308,109 | 5/1990 | Maglica et al. | D26/49 |
| 1,823,778 | 9/1931 | Bailey | 40/655 |
| 2,249,691 | 7/1941 | Gelardin | 362/206 |
| 2,443,539 | 6/1948 | Kopp | 200/60 |
| 2,490,830 | 12/1949 | Norton | 362/205 |
| 2,540,683 | 2/1951 | MacLean | 200/60 |
| 2,677,022 | 4/1954 | Fleming | 200/60 |
| 2,725,788 | 12/1955 | Pfleger | 359/803 |
| 2,945,111 | 7/1960 | McCormick | 200/526 |
| 3,523,168 | 8/1970 | Holmes | 200/526 |
| 3,835,272 | 9/1974 | Wisenbaker | 362/206 |
| 4,114,187 | 9/1978 | Uke | 362/158 |
| 4,213,078 | 7/1980 | Ferrell et al. | 320/2 |
| 4,472,766 | 9/1984 | Hung | 362/158 |
| 4,484,253 | 11/1984 | Roberts | 362/206 |
| 4,531,178 | 7/1985 | Uke | 362/158 |
| 4,577,263 | 3/1986 | Maglica | 362/187 |
| 4,581,686 | 4/1986 | Nelson | 362/204 |
| 4,658,336 | 4/1987 | Maglica | 362/197 |
| 4,733,337 | 3/1988 | Bieberstein | 362/206 |
| 4,841,417 | 5/1989 | Maglica et al. | 362/206 |
| 4,956,755 | 9/1990 | Maglica et al. | 362/206 |
| 5,158,358 | 10/1992 | Maglica et al. | 362/206 |

FOREIGN PATENT DOCUMENTS

| | | |
|---|---|---|
| 514620 | 11/1930 | Japan . |
| 1419704 | 12/1939 | Japan . |
| 45-33197 | 12/1970 | Japan . |
| 411218 | 6/1934 | United Kingdom . |

OTHER PUBLICATIONS

Police vol. 11, No. 2, Feb. 1987, cover and page 61.

*Primary Examiner*—Ira S. Lazarus
*Assistant Examiner*—L. Heyman
*Attorney, Agent, or Firm*—Lyon & Lyon

[57] ABSTRACT

A flashlight having a switch and beam adjustment mechanism located in the tailcap whereby the flashlight may be turned on and focused with one hand without changing the grip on the flashlight by that hand. Batteries of "AAAA" size are contemplated for use in one embodiment of the flashlight.

1 Claim, 7 Drawing Sheets

TAILCAP SWITCH FOCUS FLASHLIGHT

This application is a division, of application Ser. No. 07/963,133, filed Oct. 19, 1992, now abandoned; which is a divisional of Ser. No. 350,385, filed May 11, 1989, now U.S. Pat. No. 5,158,358; which is a continuation of Ser. No. 106,296, filed Oct. 7, 1987, now U.S. Pat. No. 4,841,417, which is a C-I-P of Ser. No. 07/043,086, filed Apr. 27, 1987, now U.S. Pat. No. 4,819,141; which is a C-I-P of Ser. No. 07/034,918, filed Apr. 6, 1987, now abandoned; which is a continuation of Ser. No. 06/828,729, filed Feb. 11, 1986, now U.S. Pat. No. 4,658,336; which is a continuation of 06/648,032, filed Sep. 6, 1984, now U.S. Pat. No. 4,577,263.

BACKGROUND OF THE INVENTION

The present invention relates primarily to flashlights, and in particular to a flashlight which can be conveniently held and operated by one hand.

Flashlights of varying sizes, shapes and switch configurations are well-known in the art. Most known flashlights utilize dry cell batteries as their source of electrical energy. Sometimes two or more such batteries are carried in series within a tube serving as a handle for the flashlight. Typically, an electrical current is established from one electrode of the battery through a conductor to a switch, then through another conductor to another electrode of the lamp bulb. After passing through the filament of the lamp bulb, the electrical current emerges to a second electrode of the lamp bulb in electrical contact with a conductor, which in turn is in electrical contact with the flashlight housing or another conductor positioned within and along the housing. The flashlight housing usually provides an electrical conducting path to an electrical conductor, generally a spring, in contact with the other electrode of the battery series. Actuation of the switch to complete the electrical circuit enables the electrical current to pass through the filament, thereby generating light which is typically focused by a reflector to form a beam of light.

Various flashlight designs have addressed improvements to the optical characteristics of the flashlight. For example, certain designs incorporate highly reflective, well-defined reflectors to enhance the quality of the light beam for a given battery configuration. Also, flashlights having a variable focus have been developed for various sizes of flashlights. The flashlight disclosed in my U.S. Pat. Nos. 4,577,263 and 4,658,336 illustrate a miniature flashlight having such improved characteristics. In that flashlight, the switching mechanism is incorporated into the head and insulator assemblies such that rotation of the head assembly relative to the housing, or barrel, will cause the flashlight to switch on and off, and further rotation will cause the reflector to move with respect to the bulb, thus varying the dispersion of the reflected light beam. In that flashlight, the head assembly also may be removed from the barrel and utilized as a base into which the tailcap and barrel may be inserted in its on condition for use as a table lamp.

One of the disadvantages of certain flashlights whether they be "full-sized" flashlights or "miniature" flashlights is that these designs are such as to make the switching on and off and the focusing of the beam awkward, if not impossible to accomplish with the hand that is holding the flashlight by its barrel, or, handle. Because there exists a wide variety of uses for hand-held flashlights wherein the use would be facilitated by having a design such that the flashlight could be held in one hand, switched on and off and focused with that same hand, it may be seen as a deficiency in this art that heretofore no flashlight combining features to provide for such ease of operation has been developed. It is therefore desirable to provide a flashlight to be held in one hand and for which the switching and focusing operations may be performed with the hand holding the flashlight and without requiring that hand to change its grip on the flashlight while switching or focusing. It is also desirable in certain circumstances to provide a flashlight having "one-hand" operation where a particular focus after having been adjusted is maintained during the switching operation.

SUMMARY OF THE INVENTION

It is an object of the present invention to provide a flashlight having a tailcap mechanism for adjusting the beam of light.

It is another object of the present invention to provide a flashlight having an improved switch located at the tailcap.

It is another object of the present invention to provide a hand-held flashlight having a tailcap push button switch in combination with an tailcap adjusted adjustable beam.

It is another object of the present invention to provide a flashlight having an improved switch.

DETAILED DESCRIPTION OF THE PREFERRED EMBODIMENT

By reference to FIGS. 1–10, a first preferred embodiment is described.

Figure 1:
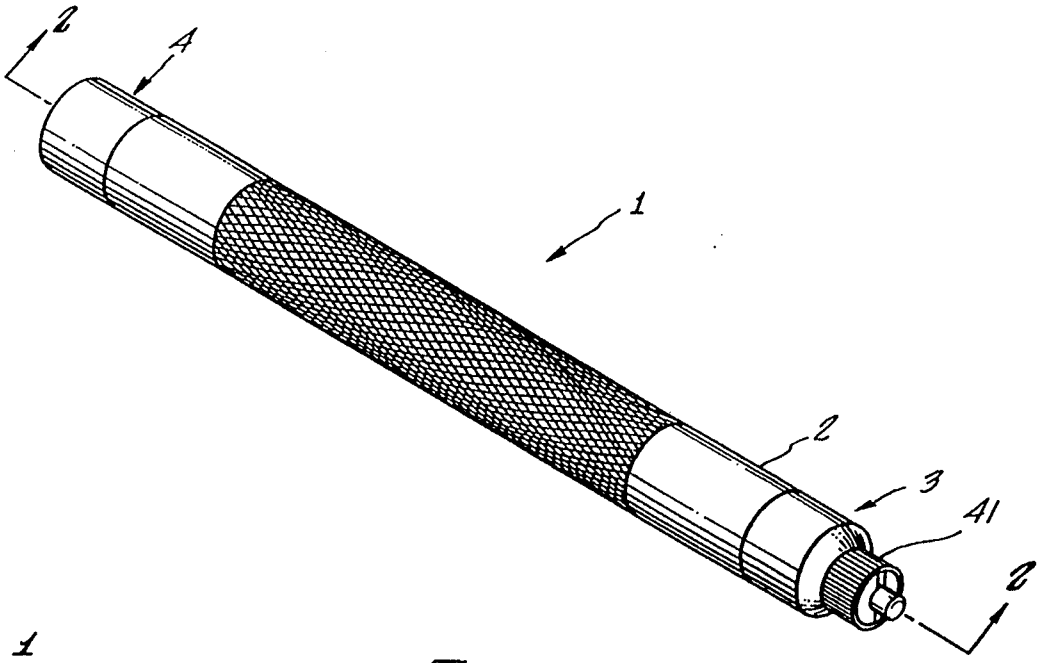
FIG. 1 is a rear perspective of a first preferred embodiment flashlight of the present invention.
Figure 2:
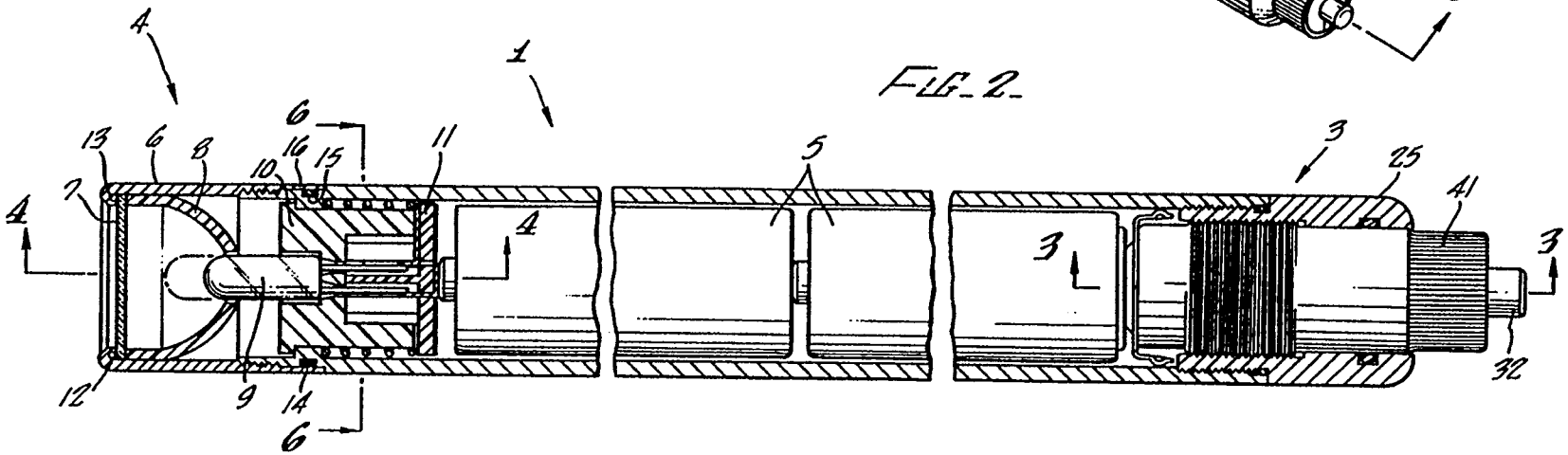
FIG. 2 is a foreshortened, overall cross-sectional view of the flashlight of FIG. 1 taken along line 2—2.

The first preferred embodiment of the present invention is generally shown in FIGS. 1–2. The flashlight 1 comprises generally a right circular cylinder, or barrel 2, enclosed at a first end by a tail assembly 3 and enclosed at a second end by a head assembly 4. The barrel, tail assembly and head assembly preferably have the same maximum outer diameter. The barrel 2 includes two dry cell batteries 5.

The dry cell batteries of the preferred embodiments are of the "AAA" or "AAAA" size, although the flashlight barrel may be adapted to retain one or more other battery sizes.

Figure 20:
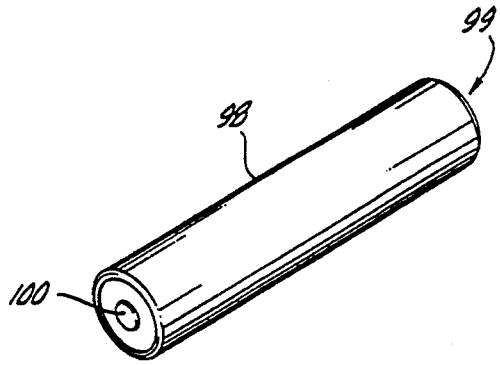
FIG. 20 is a perspective view of a "AAAA" battery of the present invention.

The "AAAA" size battery 98 of the present invention is of conventional dry cell battery shape, as shown in FIG. 20, with a typical length from lower electrode 99 to upper electrode 100 of 1.62–1.65 inches, a typical length of the upper electrode extension beyond the casing of 0.04 inches minimum, and a typical length of the lower electrode extension beyond the casing of 0.003 inches minimum. The "AAAA" battery has a typical diameter of about 0.305 to 0.325 inches and is rated at 1.5 volt.

Figure 4:
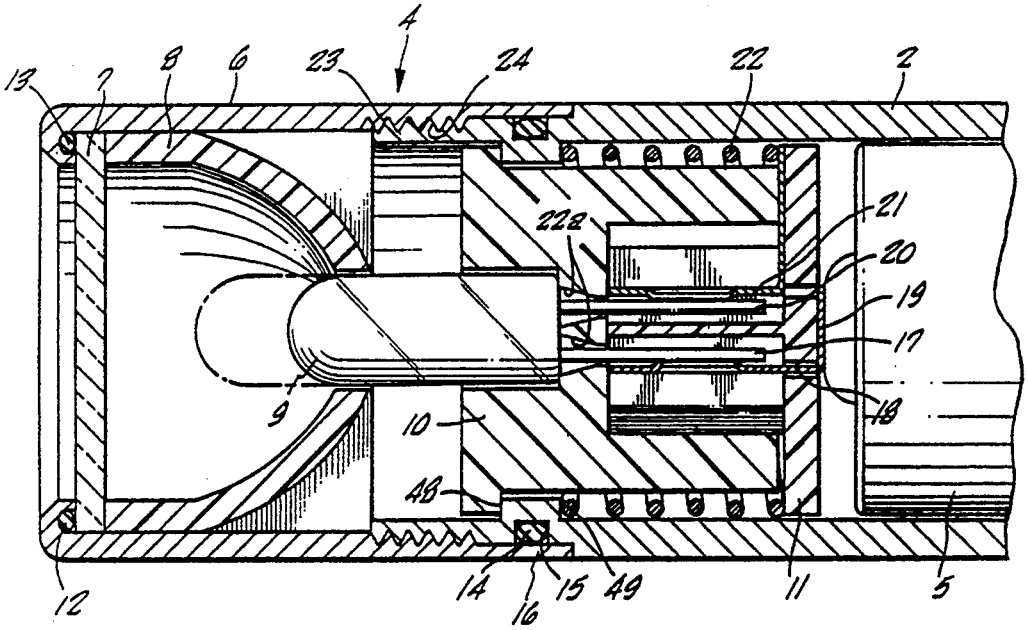
FIG. 4 is a partial cross-sectional view of the head assembly of FIG. 2 taken along line 4—4.

The head assembly 4, as shown in FIGS. 2 and 4, includes face cap 6, lens 7, parabolic reflector 8, bi-pin lamp 9, upper insulator 10 and lower insulator 11. O-ring 12 is positioned in groove 13 formed by the forward edge of the face cap 6 and is held in place by the front of lens 7. O-ring 14 is positioned in groove 15 formed in the barrel 2 and is held in place at its outer periphery by the rear extension of face cap 6, shown at 16.

Referring to FIG. 4, positive pin 17 extends rearward from the bi-pin lamp 9 through the upper insulator 10 and into the lower insulator 11 to make contact with positive contact 18, which in turn makes contact with the forward battery electrode 9. Ground pin 20 also extends rearward from the bi-pin lamp 9 through the upper insulator 10 and into the lower insulator 11 to make contact with ground contact 21, which in turn makes contact with the barrel 2 via conducting spring 22. The passageways **22*a* of the upper insulator 10 through which the pins 17 and 20 pass taper outwardly toward the pin receiving end to facilitate entry of the pins therein. Further constructional details of the insulators and contacts are shown in FIG. 5**.

As may be seen from FIGS. 2 and 4, the force of the spring 22 maintains the relative position of the insulators, contacts and bi-pin lamp so as to form a conductive path. When the batteries move forward relative to the barrel 2, as will be described in detail hereinafter, the spring 22 compresses, and the contacts, insulators and bi-pin lamp all move forward relative to the barrel 2, the face cap 6 and the parabolic reflector 8 without disrupting the conductive path described above. In this way, the beam of light is focused from a floodlight to a spotlight and vice versa, upon forward or rearward movement of the batteries 5 relative to the barrel 2. FIGS. 2 and 4 illustrate by phantom lines a forward position of lamp 9 resulting from forward movement of the batteries.

Face cap 6 has inner threads 23, shown in FIG. 4, for rotatably mounting onto the barrel 2 at its outer threads 24. During focusing of the beam from spotlight to floodlight and vice versa, face cap 6 remains stationary. During normal operation the face cap 6 remains fixed in relation to the barrel 2.

Figure 5:
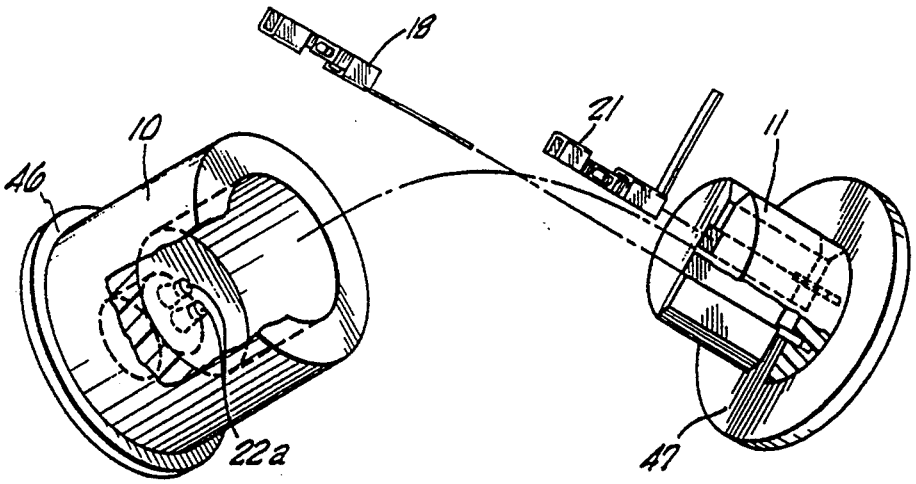
FIG. 5 is an exploded view of the upper and lower insulators of FIG. 4.
Figure 7:
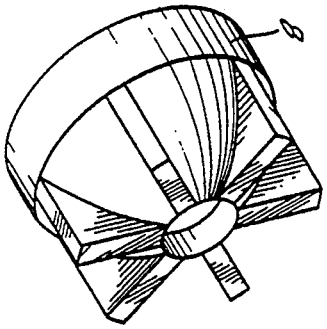
FIG. 7 is a rear perspective view of the reflector of FIG. 4.
Figure 8:
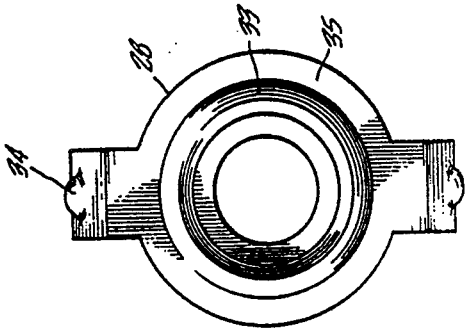
FIG. 8 is a top plan view of the annular contact of FIG. 3.
Figure 6:
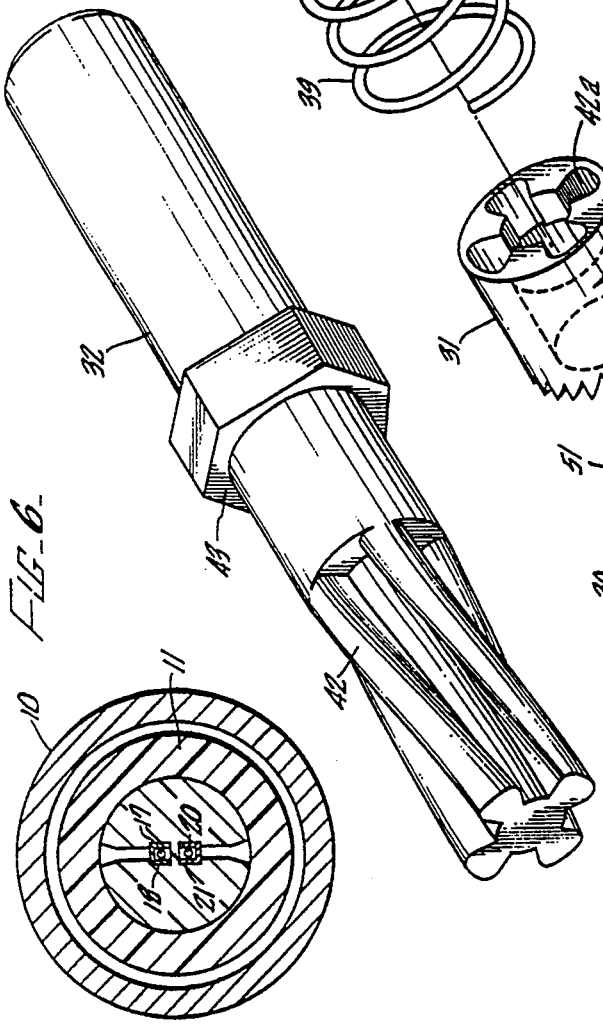
FIG. 6 is a cross-sectional view of FIG. 2 taken along line 6—6.

As shown in greater detail in FIG. 5, upper insulator 10 and lower insulator 11 each have a shoulder 46 and 47, respectively.

Shown in FIG. 4, O-ring 14 fits snugly in groove 15 on the outer periphery of the barrel. The shoulder 48, adjacent to groove 15, provides a rest for upper insulator shoulder 46. Spring 22 is disposed between the shoulder 49 and the lower insulator shoulder 47. Longitudinal movement of the batteries will cause corresponding longitudinal movement of the assembled upper and lower insulators together with the inserted lamp 9 against the force of coil spring 22. This movement is relative to the fixed reflector 8 and causes the dispersion of the light beam to vary from a floodlight to a spotlight focus.

Figure 3:
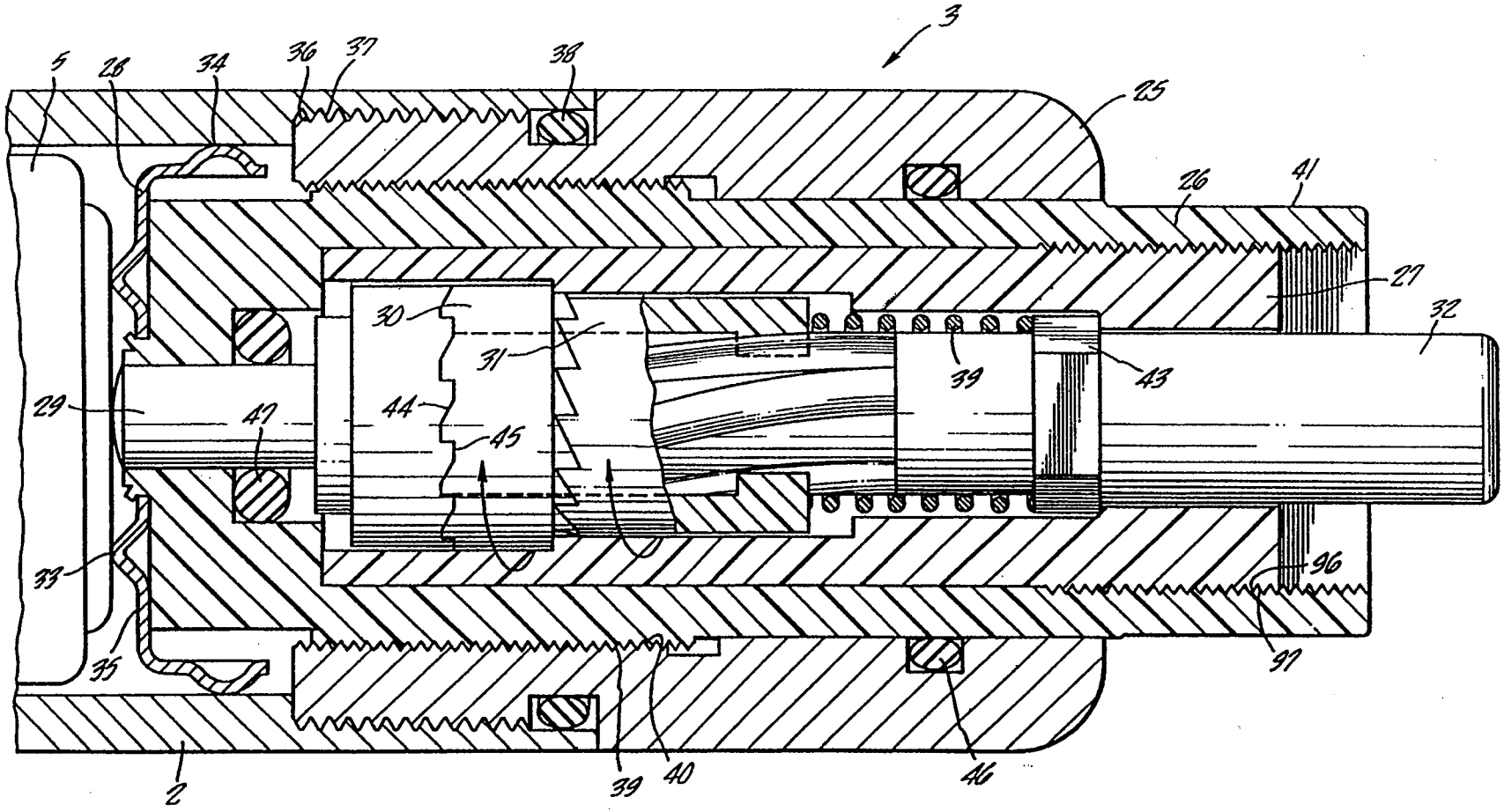
FIG. 3 is a partial cross-sectional view of the tail assembly of FIG. 2 taken along line 3—3.

Referring to FIG. 3, tail assembly 3 comprises a tail cap 25, outer housing 26, inner housing 27, annular contact 28, plunger 29, indexee 30, indexer 31, spring 39 and push button 32. As shown in FIG. 3, the tail cap assembly is in the "on" position. In the on position, the rearward portion of the rear battery 5 makes contact at 33 with annular contact 28 which extends radially outward to make contact at 34 with the barrel 2. The forward edge of plunger 29 is recessed within the region defined by the edge of the crimped portion at 33 and the face portion, shown at 35 of annular contact 28. Annular contact 28 is shown in greater detail in FIG. 8.

Tail cap 25 is positioned by rotating its outer threads 36 into the barrel inner threads 37, with O-ring 38 providing an effective seal. Outer housing 26 is rotatably positioned within tail cap 25 by tail cap inner threads 39 and outer housing outer threads 40. The outer housing 26 is moved relative to the tail cap 25 and the barrel 2 by rotating the outer housing at its rearward projection, shown at knurled portion 41.

Inner housing 27 is positioned inside the outer housing by outer threads 96 and outer housing inner threads 97 shown at the rearward portions of the housings.

Figure 9:
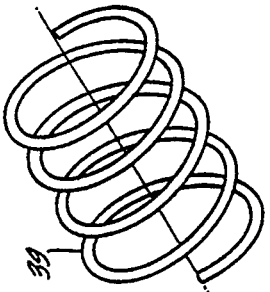
FIG. 9 is a perspective view of the push-button of FIG. 3.
Figure 10:
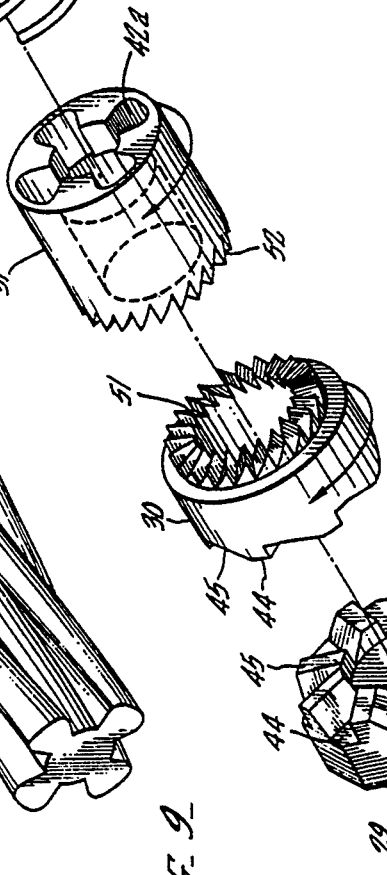
FIG. 10 is an exploded perspective view of the plunger, indexee, indexer and spring of FIG. 3.

As shown in FIGS. 3, 9 and 10, positioned within the inner housing are indexee 30, indexer 31, spring 39 and, push button 32. On the inside surface of inner housing 27 is a set of female hex splines. On the forward outside surface of push button 32 is a set of male hex splines 42 sized and arranged to cooperate with the female splines on inner housing 27. Push button 32 has a shoulder 43 against which spring 39 pushes to keep the push button in a normal, rearward extending position. Adjacent to the forward end of the spring 39 and within inner housing 27 is positioned indexer 31. As shown in greater detail in FIG. 10, indexer 31 is provided with a set of female hex splines **42*a* arranged to cooperate with the male splines 42 of the push button 32 upon longitudinal movement of the push button. With each push of the push button 32, the longitudinally and radially advancing male splines cause the indexer 31 to rotate one increment. Indexee 30 has at its rearward end a sawtooth configuration 51 arranged to cooperate with a complimentary sawtooth configuration 52 on the forward end of indexer 31. Indexee 30 has at its forward end alternating relatively high surfaces at 44 and relatively low surfaces at 45 with a sloping portion therebetween at one side and a vertical portion at the other side. The rearward end of plunger 29 also has alternating relatively high surfaces, shown at 45 and relatively low surfaces, shown at 44, with sloping and vertical portions therebetween to form teeth. These plunger surfaces compliment the correspondingly numbered surfaces on the forward end of indexee 30. Thus the relatively high surfaces 45 of the plunger correspond to the relatively low surfaces 45 of the indexee. When the relatively high surfaces of the plunger and indexee 45, 44 respectively, are in contact with each other, then the forward edge of plunger 29 is in its extended position and the electrical contact at 33 is broken. When the relatively low surfaces 44 of the plunger are in contact with the relatively high surfaces 44 of the indexee, then plunger 29 is in is retracted position, shown in FIG. 3, and electrical contact between the batteries and annular contact 28 is made at 33**.

The surfaces of the teeth on the rear of the plunger 29 and forward end of indexee 30 are arranged so that each increment of rotation of indexer 31 alternatingly produces an extended and then a retracted position of plunger 29. The plunger 29 extends out to and remains at its fully extended position upon operation of the push button. Unlike corresponding plungers or push button switches of the type found in ball point pens and the like, no part of the plunger 29 or push button 32 extends beyond a reference plane during operation, where the reference plane is defined as the plane at which the forward end of the forward plunger or push button touches at the completion of the switching operation.

The plunger 29 does not rotate upon rotation of indexee 30. The length of movement of plunger 29 is the distance between the peaks at 44 of indexee 30 and valleys at 45 of indexee 30 shown in FIG. 10. Such extension, or movement of plunger 29 from the position shown in FIG. 3, will in turn cause the batteries, insulators 10, 11, and lamp 9 to move forward slightly, relative to the barrel 2, such that contact between the batteries 5 and annular contact 28, shown at 33, is broken. When the push button is pushed again, the indexes will return the plunger 29 to its former position relative to barrel 2, contact will be made at 33 and the flashlight will turn on with the same focus as it had when it was last on, assuming that outer housing 26 had not been rotated in the interim. During normal focusing of the beam and during switching operations, tail cap 25 remains in fixed relation to barrel 2. Sealing the inside of the flashlight at the tail end is provided by O-rings located at 38, 46 and 47.

An optional ground contact arrangement, not shown, for the upper and lower insulators of the head assembly may be used. In the first preferred embodiment, the ground contact 21 extends through the lower insulator 11, making contact with the ground pin 20 of the bi-pin lamp and extends down to a level adjacent to the shoulder 47 of the lower insulator 11 and then extends radially outward along the shoulder of the lower insulator adjacent to the inner surface of the barrel and makes contact with coil spring 22. In an optional construction, the ground contact may be constructed and arranged so that it rests in the upper and lower insulator adjacent to the ground pin of the bi-pin lamp; however, the ground contact is made to extend in a forward direction towards the forward edge of the upper insulator 10 and then to extend radially outward along the shoulder 46 of the upper insulator to a position adjacent to the inner surface of the barrel 2 and then to extend rearward, or downward toward the inner shoulder 48 formed adjacent groove 15, thus providing for an electrical contact between the ground contact and the barrel inward of and near to groove 15.

Switching and focusing operation of the flashlight of the present invention will now be described in relation to the flashlight components shown in FIGS. 2, 3 and 4. In FIG. 3, the flashlight is shown in an on configuration. As shown, the plunger 29 is in a retracted or recessed position such that its forward edge is beneath the plane defined by the crimped or forward portion at 33 of the annular contact 28. In this on configuration, the bottom surface or electrode of the battery 5 touches the annular contact at 33 and provides for completion of the electrical circuit. The electrical circuit is, beginning at 33, through the batteries up through the positive electrode 19 of the upper battery, through the positive contact 18 to the positive pin 17 of the bi-pin lamp, through the bi-pin lamp filament, returning from the bi-pin lamp filament through ground pin 20, and ground contact 21 to coil spring 22, from coil spring 22 to the upper portion of the barrel 2 and then from the upper portion of the barrel 2 through the barrel wall down through the outer portions of annular contact 28 at 34, and finally through annular contact 28 to its upper crimped region at 33 to complete the circuit with the lower electrode of the batteries.

If a barrel made of a insulating material, such as plastic, is desired, then a strip of conductive material, or an inner cylinder of conductive material may be positioned inside of the barrel to provide a conductive path from ground contact 21 down to the annular contact 28. Also, a conventional lamp having a screw or socket base may be used, with appropriate modification in the insulator assembly to provide for holding the bulb and for creating and maintaining a conductive path.

Focusing of the beam is accomplished by rotation of the outer housing 26. As may be seen in FIGS. 1–2, the outer housing has projection or extension 41 rearward of the tailcap and this extension has a knurling or channeling feature. Rotation of the outer housing at the rearward extension causes longitudinal movement of the outer housing at threads 39 and 40. Longitudinal movement of the outer housing also necessarily causes longitudinal movement of all of the parts contained therein, i.e., the inner housing, the indexer, the indexee, the plunger and the spring. Also, such movement of the outer housing causes a slight longitudinal movement of the annular contact within the barrel.

Operation of the push button switch will also cause a longitudinal movement of the batteries, the upper and lower insulators and the lamp relative to the barrel. However, it should be readily apparent that upon return of the flashlight to an on condition, the position of the batteries, the upper and lower insulators, and the lamp is the same position that existed prior to switching the flashlight to an off position, assuming that the outer housing had not been rotated when the flashlight was in the off position.

Figure 11:
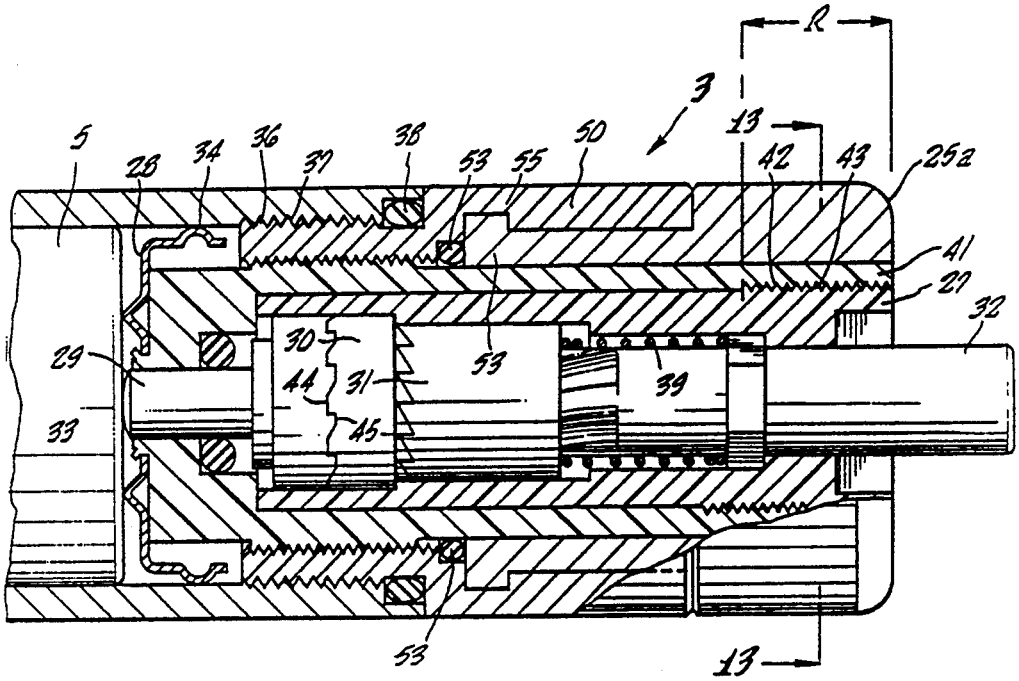
FIG. 11 is a partial cross-sectional view of the tail assembly of a second preferred embodiment of the flashlight of the present invention.
Figure 18:
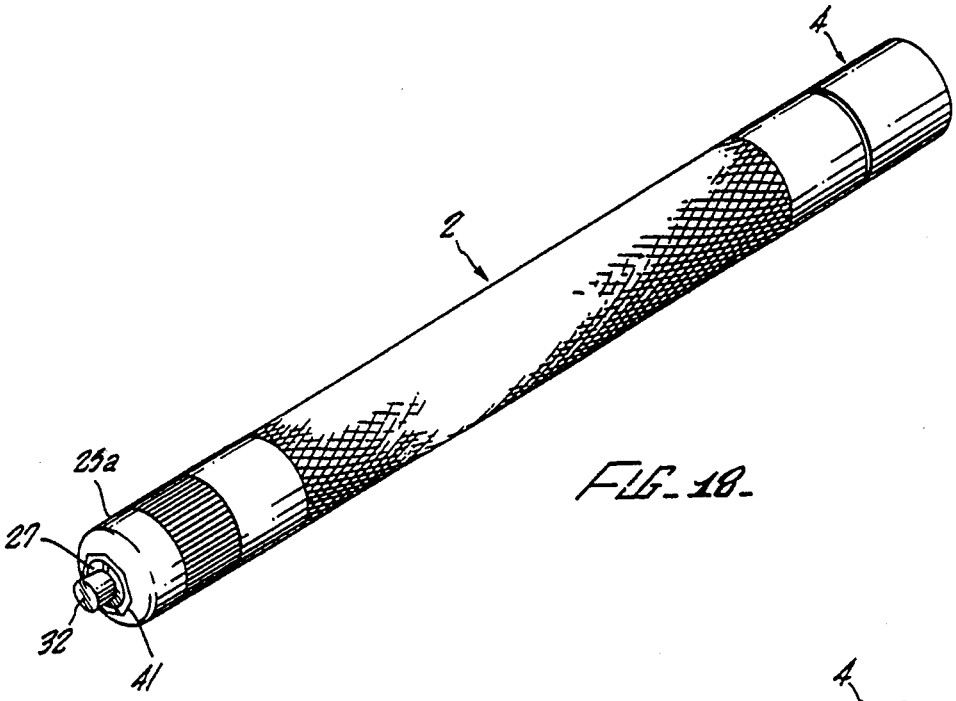
FIG. 18 is a rear perspective of the second preferred embodiment of the present invention.

By reference to FIGS. 11, 13 and 18 a second preferred embodiment will be described. In the second preferred embodiment, a tail assembly somewhat different in structure from the one shown in, e.g. FIG. 3, is employed. In the second preferred embodiment, the tailcap is fashioned from two complimentary parts, i.e., tailcap end 25*a* and tailcap connector 50; shown in FIG.

11. The end 25*a* and connector 50 snap fit together at the forward extension 53 of tailcap end 25*a* and midrecess 55 of connector 50, as shown in FIG. 11. Tailcap end 25*a* has a female octagon shape on its inner radius extending from the rearward end to a predetermined distance R toward the forward extension 53. The outer housing 41 is made to be of male octagon shape at its rearward end and for the same predetermined length P as regarding the female octagon shape of tailcap end 25*a*. The octagon portion of tailcap end 25*a* and outer housing 41 thus cooperate with each other so that rotation of the tailcap end 25*a*, which may have knurling or channeling, will cause corresponding rotation of outer housing 41, and longitudinal movement of the bulb relative to the reflector as discussed in relation to the first preferred embodiment. The operation of the push button 32 and corresponding switching components operate in the same way as described with respect to the first preferred embodiment. The octagon shape and cooperative arrangement of tailcap end 25*a* with outer housing 41, together with inner housing 27 and push button 32 are shown in FIGS. 13 and 18.

By reference to FIGS. 12, 14–17 and 19, a third preferred embodiment will be described.

Figures 13, 14, 15, 16, 17:
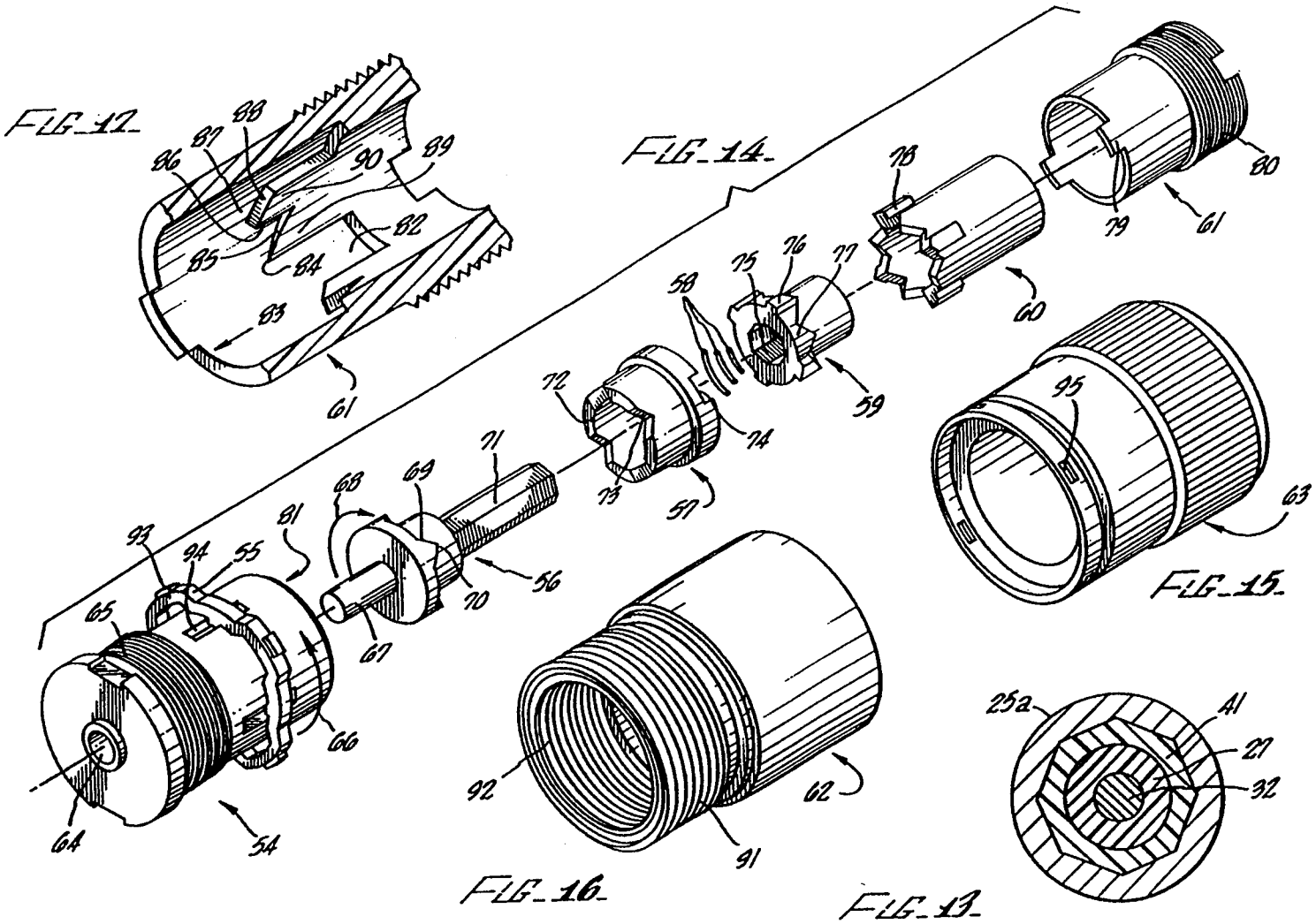
FIG. 13 is a partial cross-sectional view of the tail assembly of FIG. 11 taken along line 13—13.
FIG. 14 is an exploded perspective view of the ratchet housing, lock ring, ratchet pusher, detent, conical compression spring, index gear, transfer gear and holder of the third embodiment, shown in FIG. 12.
FIG. 15 is a perspective view of the tailcap button of FIG. 12.
FIG. 16 is a perspective view of the special tailcap section of FIG. 12.
FIG. 17 is a partial perspective view of the holder of FIG. 12, showing internal teeth.

The third preferred embodiment features an alternate tail assembly structure comprising a ratchet housing 54, lock ring 55, ratchet pusher 56, detent 57, conical compression spring 58, index gear 59, transfer gear 60, holder 61, special tailcap section 62 and tailcap button 63 as shown in FIGS. 14–16.

The third preferred embodiment is assembled by first fitting together ratchet housing 54, ratchet pusher 56, detent 57, conical compression spring 58, index gear 59, transfer gear 60 and holder 61 to form a first subassembly. Then lock ring 55 is snapped onto ratchet housing 54 at grove 94, shown in FIG. 14, to form a second subassembly. Next, the second subassembly is screwed into special tailcap section 62 at inner threads 92 of special tailcap section 62 and at outer threads 65 of ratchet housing 54 to form a third subassembly. Next, tailcap button 63 is snapped into the third subassembly and over tangs 93 so that the tangs 93 of lock ring 55 snap into the slots 95 of tailcap button 63 to form an assembled third preferred embodiment tailcap assembly. The assembly may then be screwed into the barrel at threads 91 shown in FIG. 16 and at barrel threads 37 shown in FIGS. 3 and 12.

By reference to FIGS. 14–17, the switching and focusing operation of a third preferred embodiment will be described. First, the switching operation from an on to an off condition will be described. Pushing tailcap button 63 causes longitudinal movement of transfer gear 60 and index gear 59 along slot 82, which in FIG. 17 shows the internal teeth configuration of holder 61. This longitudinal direction of movement is also shown as the direction of arrow 83 in FIG. 17. By this motion, index gear 59 is lifted along and inside of the holder 61. The guide tangs 78 on transfer gear 60 and the guide tangs 76 on index gear 59 extend radially outward of the main cylindrical bodies of transfer gear 60 and index gear 59 respectively, as shown in FIG. 14. These radially outwardly extending tangs 78 and 76 slide in slot 82, located on the inner surface of holder 61. As shown in more detail in FIG. 17, the inner surface of holder 61 has formed on it a series of slots 82 and teeth 89 and 90, with peaks 84 and 87 as well as slanted, or inclined teeth surfaces 85 and 88 respectively. As will be further described, the switching operation of the third preferred embodiment involves longitudinal and radial movement of tangs 76. This movement is upward along the slots 82 in the direction of arrow 83, then downward and radially along surfaces 85, then longitudinally along the vertical surfaces 86 of teeth 90 in the direction of arrow 83, and then downward and radially along slanted surfaces 88 of teeth 90 to produce longitudinal to radial to longitudinal indexing of the pusher 67 to open or close the electrical circuit of the flashlight.

Upon pushing tailcap button 63, the movement of tangs 76 at first is solely a longitudinal movement in the direction of arrow 83 and against the force of conical compression spring 58, shown in FIG. 14. As also may be seen in FIG. 14, this initial longitudinal movement is also along the shaft 71 of ratchet pusher 56.

Upon continued pushing of tailcap button 63, the tangs 76 continue to move in the direction of arrow 83 until tangs 76 clear peaks 84 of index position teeth 89, shown in FIG. 17. At that time, the force of conical compression spring 58 in conjunction with the inclined surfaces 85 of the teeth 89 cause the index gear 59 to slip down along inclined surfaces 85 in longitudinal motion and also simultaneously causing index gear 59 to rotate as it slips downwardly along inclined surfaces 85. As may be noted from FIG. 14, ratchet pusher 56 also rotates upon the rotation of index gear 59 because male hex surfaces on shaft 71 of the ratchet pusher 56 cooperate with female hex surfaces 75 of index gear 59. Thus, whenever there is rotation of index gear 59, there is corresponding rotation of ratchet pusher 56 in the direction of arrow 68.

Upon rotation of ratchet pusher 56, the tips 70 of teeth 69 are moved from the valleys 73 of detent 57 to relatively higher surfaces 72 of detent 57. This movement of teeth 69 from the valley 73 to the surfaces 72 in turn causes longitudinal movement of ratchet pusher 56 in the direction of arrow 83. The longitudinal movement of ratchet pusher 56 pushes its end 67 through the hole 54 in the ratchet housing 54. Movement of the end 67 of ratchet pusher 56 then pushes the batteries toward the head assembly and breaks the contact with the rear battery electrode at 33, shown for example, in FIG. 3. As may be observed, when the flashlight is in the off position, then the tips 70 of teeth 69 are resting on the relatively higher surfaces 72 of detent 57.

Next, the switching operation from an off position to an on position will be described in reference to FIGS. 14–17. With the flashlight in an off position and the tips 70 of teeth 69 resting on relatively higher surfaces 72 of detent 57, the tailcap button is pushed, causing longitudinal movement of transfer gear 60 and index gear 59 to move longitudinally only, that is without any rotational movement, along the sides 86 of teeth 90 until the tangs 76 of index gear 59 reach the peaks 87 of the teeth 90. When the tangs 76 of index gear 59 reach the peaks 87, then conical compression spring 58 forces index gear 59 longitudinally downward along inclined surfaces 88, as shown in FIG. 17. This longitudinally downward motion along the inclined surfaces 88 also causes rotation of index gear 59 as it travels along the slanted surfaces 88. As described before, rotation of index gear 59 causes rotation of ratchet pusher 56 because the male hex surfaces 71 on ratchet pusher 56 cooperative with female hex surfaces 75 in index gear 59. As ratchet pusher 56 is rotated, then the tips 70 of teeth 69 are moved along the relatively higher surfaces 72 of detent 57 until they reach the sloping surfaces of valleys 73. When the tips 70 of the teeth 69 reach the sloping surfaces then the ratchet pusher 56, including its end 67 move longitudinally opposite the direction of arrow 83. This movement of the end 67 causes the batteries to be moved rearward by the force of spring 22 in the head assembly, shown in FIG. 4 and makes the electrical contact between the rear electrode of the rear battery 5 and the annular contact 28 at 33, shown in FIG. 3, thus closing the circuit and switching the flashlight on.

The sloping surfaces 85 and 88 are chosen to be of an angle and of a length so that each complete index cycle will result in a 45° rotation of those parts which rotate. As the tangs 76 reach the end of the inclined surfaces 88 the conical compression spring 58 continues to exert force on index gear 59 and causes it to then continue moving longitudinally into slots 82, as shown in FIG. 17.

The ratchet pusher 56 serves as a driver between ratchet housing 54 and tailcap button 63 so that when tailcap button 63 is rotated by hand to adjust the beam of the flashlight as described above in regard to other preferred embodiments, then lock ring 55 causes ratchet housing 54 to also rotate. This rotational movement of the ratchet housing 54 at outer ratchet housing threads 65 coupled to corresponding inner threads 92 of special tailcap section 62 will then result in a longitudinal movement of the entire inner tailcap assembly comprising the ratchet housing 54, lock ring 55, ratchet pusher 56, detent 57, conical compression spring 58, index gear 59, transfer gear 60 and holder 61. The longitudinal movement of this assembly then causes corresponding longitudinal movement of the batteries against the force of spring 22 and correspondingly causes longitudinal movement of the bulb 9 relative to the reflector 8 to focus, or adjust, the beam as previously described with respect to the other preferred embodiments.

Tangs 79 on holder 61 cooperate with slots 74 on detent 57 so that rotation of tailcap button 63 will provide for rotation without longitudinal movement of the ratchet and gear components. In this way, focusing may be accomplished without inadvertant switching of the flashlight from on to off or vice versa. Holder 61 is anchored by virtue of its being screwed at its outer threads 80 along inner threads 81 of the rearward portion of ratchet housing 54. In order to prevent detent 57 from rotating with rotational movement of ratchet pusher 56 when the teeth 69 are rotated into the valleys 73 of detent 57, tangs 79 of holder 61 mate with slots 74 of detent 57.

Figure 12:
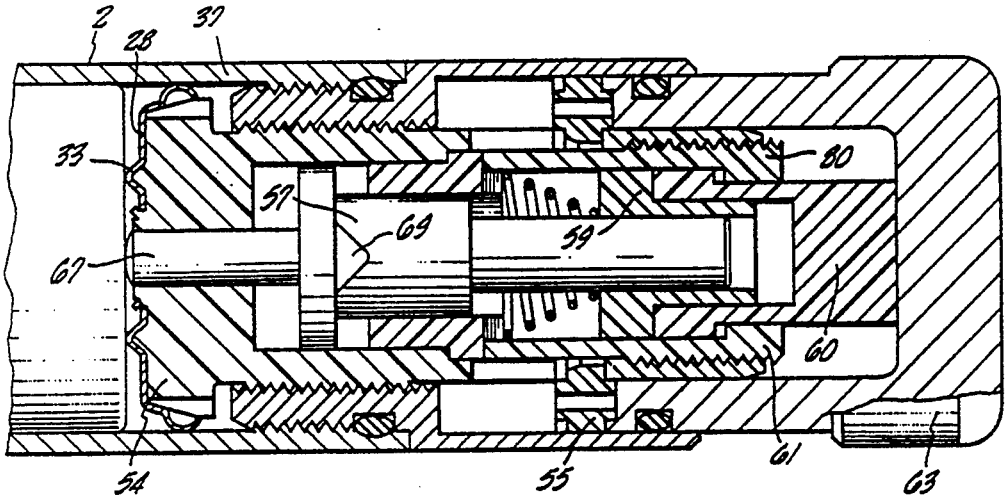
FIG. 12 is a partial cross-sectional view of the tail assembly of a third preferred embodiment of the flashlight of the present invention.
Figure 19:
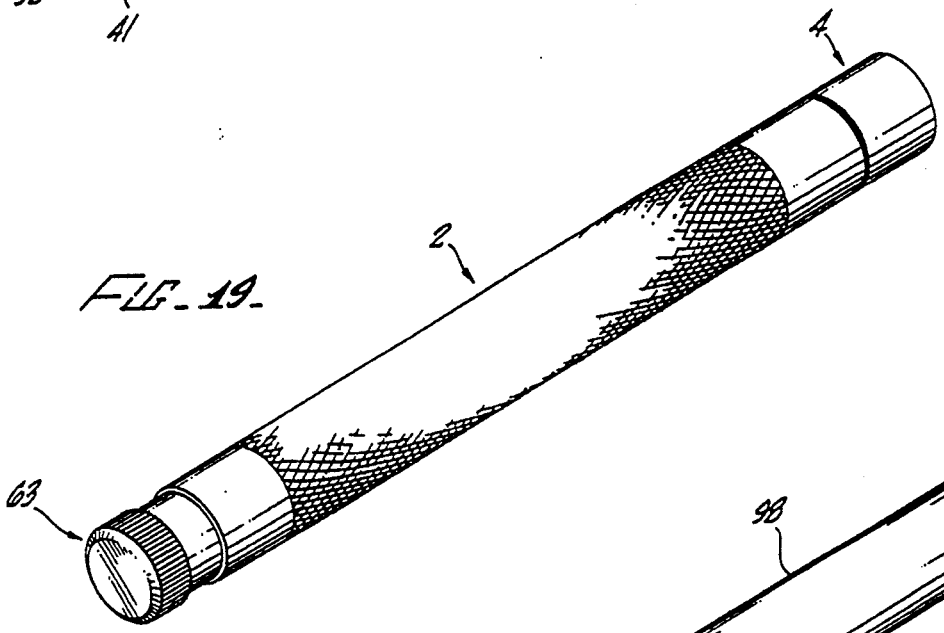
FIG. 19 is a rear perspective of the third preferred embodiment of the present invention.

As shown FIGS. 12, 15 and 19, the third embodiment tailcap button 63 is a single constructional element which serves to initiate both the switching function as well as the beam adjustment, or focus function.

As may be seen from the above description, the present invention provides for a flashlight that can be held in one hand, switched on and off and focused with the same hand without changing the grip of the holding hand, thus freeing the other hand for other activities.

It is contemplated that numerous modifications may be made to the flashlights and actuators of the preferred embodiments shown in the drawings and described above without departing from the spirit of the invention.

We claim:

1. A flashlight comprising a barrel sized to retain at least one battery;

a socket slidably retained in said barrel at a first end of said barrel;

a lamp mounted in said socket;

a spring between said barrel and said socket biasing said socket toward a second end of said barrel;

a substantially parabolic reflector;

a head assembly on the first end of said barrel retaining said reflector fixed relative thereto;

a tailcap at the second end of said barrel;

an on/off switch in said tailcap having a contact and a plunger, said contact extending from an inner surface of the barrel to a central position for contacting a battery electrode, said plunger selectively extending toward said barrel beyond said contact by operation of said switch, said on/off switch threadably engaging said barrel and having a extension extending from said tailcap to allow rotation of said on/off switch to move said socket and said lamp relative to said reflector.

* * * * *